United States Patent [19]

Dancy

[11] Patent Number: 4,872,766

[45] Date of Patent: Oct. 10, 1989

[54] TWO-COMPARTMENT PLASTIC BAG

[75] Inventor: Hugh G. Dancy, Hartsville, S.C.

[73] Assignee: Sonoco Products Company, Hartsville, S.C.

[21] Appl. No.: 273,954

[22] Filed: Nov. 18, 1988

[51] Int. Cl.[4] ..... B65D 30/22; B65D 33/08

[52] U.S. Cl. ..... 383/10; 383/38; 383/121; 383/122

[58] Field of Search ..... 383/10, 38; 206/427

[56] References Cited

U.S. PATENT DOCUMENTS

| | | |
|---|---|---|
| 1,510,243 | 9/1924 | Perry . |
| 1,606,115 | 11/1926 | Williams . |
| 1,808,375 | 6/1931 | Plooster . |
| 1,983,418 | 12/1934 | Thurmer . |
| 2,089,297 | 8/1937 | Read et al. . |
| 2,301,087 | 11/1942 | Snyder . |
| 2,805,814 | 9/1957 | Calasibetta et al. . |
| 3,008,835 | 11/1961 | Madding . |
| 3,114,496 | 12/1963 | Wilcox . |
| 3,173,602 | 3/1965 | Clipner . |
| 3,263,904 | 8/1966 | Warp . |
| 3,332,548 | 7/1967 | Piazze et al. . |
| 3,339,824 | 9/1967 | Luke . |
| 3,353,741 | 11/1967 | Kamins et al. . |
| 3,442,437 | 5/1969 | Mann . |
| 3,448,915 | 6/1969 | Schwarzkopf . |
| 3,454,211 | 7/1969 | Hoffman . |
| 3,512,700 | 5/1970 | Evans et al. . |
| 3,516,537 | 6/1970 | Dreyfus et al. . |
| 3,549,084 | 12/1970 | Canno . |
| 3,549,451 | 12/1970 | Kugler . |
| 3,580,486 | 5/1971 | Kugler . |
| 4,125,220 | 11/1978 | Suominen . |
| 4,164,170 | 8/1979 | Nordia . |
| 4,290,525 | 9/1981 | Sisson . |
| 4,299,324 | 11/1981 | Dickens . |
| 4,428,484 | 1/1984 | Rattay et al. . |
| 4,542,826 | 9/1985 | Adams . |
| 4,560,068 | 12/1985 | Membrino . |
| 4,588,554 | 5/1986 | Kaartinen et al. . |
| 4,696,403 | 9/1987 | Hoover . |

*Primary Examiner*—Stephen P. Garbe

*Attorney, Agent, or Firm*—Bell, Seltzer, Park & Gibson

[57] ABSTRACT

A two-compartment plastic bag is provided which is particularly adapted for carrying two large beverage bottles or like products. The bag is characterized by having structural features providing easy insertion and removal of such products into and out of the bag, and, preferably, providing easy conformability of the bottom of the bag to the shape of the product contained therein and a reinforced medial handle portion for carrying the bag.

6 Claims, 2 Drawing Sheets

TWO-COMPARTMENT PLASTIC BAG

FIELD OF THE INVENTION

This invention relates to a two-compartment plastic bag particularly adapted for carrying two large beverage bottles or like products and characterized by a construction providing easy insertion and removal of such products into and out of the bag, and, preferably, providing easy conformability of the bottom of the bag to the shape of the products contained therein and a reinforced handle portion for carrying the bag.

BACKGROUND OF THE INVENTION

Prior U.S. Pat. No. 4,696,403, assigned to the assignee of the present invention, discloses a twocompartment plastic bag for carrying two large beverage bottles or like products and which provides distinct improvements over plastic or other types of bags heretofore utilized for carrying such products.

However, the two-compartment plastic bag of this prior U.S. patent presented certain problems in use of the bag inasmuch as it failed to provide desired easy insertion and removal of the products into and out of the two compartments of the bag. Also, a problem was presented with respect to conformability of the bottom of the bag with the shape of the beverage bottles or like products contained therein. Additionally, the handle areas of this prior two-compartment plastic bag did not always provide desired strength when utilizing the bag or carrying heavy beverage bottles or like products.

OBJECTS AND SUMMARY OF THE INVENTION

Accordingly, it is the object of this invention to provide a two-compartment plastic bag for carrying two large beverage bottles or like products which provides easy insertion and removal of two large beverage bottles or like products into and out of the bag. It is a further more specific object of this invention to additionally provide preferred improved characteristics in such two-compartment plastic bag construction which provide a bottom in the bag which is readily conformable to the shape of the products contained therein and a reinforced handle portion for carrying the bag which provides improved strength.

It has been found by this invention that the above objects may be accomplished by providing a two-compartment plastic bag which is fabricated from tubular flexible thermoplastic film and which includes the following structural elements in the flat condition of the bag.

Generally coextensive overlying front and rear wall portions are integrally joined at longitudinally-extending side edges thereof, preferably without gussets therein.

A bottom portion includes a heat seal extending transversely across and securing together bottom edges of the front and rear wall portions for closing the bottom portion. Preferably, a gusseted bottom wall is formed by enfolding a predetermined length of the front and rear wall portions extending from the heat seal in the bottom portion to allow the bottom portion to be opened up to sufficient dimensions for receiving the beverage bottles or like products.

Preferably, four generally-diagonal heat seals connect the respective front and rear wall portions to a respective part of the gusseted bottom wall adjacent thereto. Each of these diagonal heat seals extend at an approximate 45° angle with respect to and from respective opposite side edges of the front and rear wall portions to the bottom of the bottom portion of the bag. With these preferred diagonal heat seals, the bottom portion will readily conform to the shape of the bottom of the beverage bottles or like products when opened up.

A top handle portion is provided which preferably includes spaced-apart heat seals extending transversely across and securing the front and rear wall portions at a top area thereof. A hand-receiving cutout is formed through the front and rear wall portions between the spaced-apart heat seals and is positioned generally medially of the side edges of the front and rear wall portions to form a medial grippable handle in the bag. Preferably, the top handle portion includes at least four layers of thermoplastic film for providing reinforcement and strength to the grippable handle.

A heat seal extends generally longitudinally of and connects the front and real wall portions from the top handle portion toward the bottom portion and is positioned generally medially between the side edges of the front and rear wall portions to define side-by-side compartments within the bag.

An open mouth portion is provided at the top of each of the compartments on each side of the top handle portion. These open mouth portions are formed by respective oppositely curved cutouts of the front and rear wall portions and each of which extends downwardly from the top of the top handle portion and outwardly to respective side edges of the front and rear wall portions to form an easy insert mouth for each of the compartments in the bag.

BRIEF DESCRIPTION OF THE DRAWINGS

Some of the objects and advantages of this invention have been set forth above, other objects and advantages will appear in the following more detailed description of a preferred embodiment of this invention, when taken in conjunction with the accompanying drawings, in which.

DETAILED DESCRIPTION OF PREFERRED EMBODIMENT OF THE INVENTION

Figure 7:
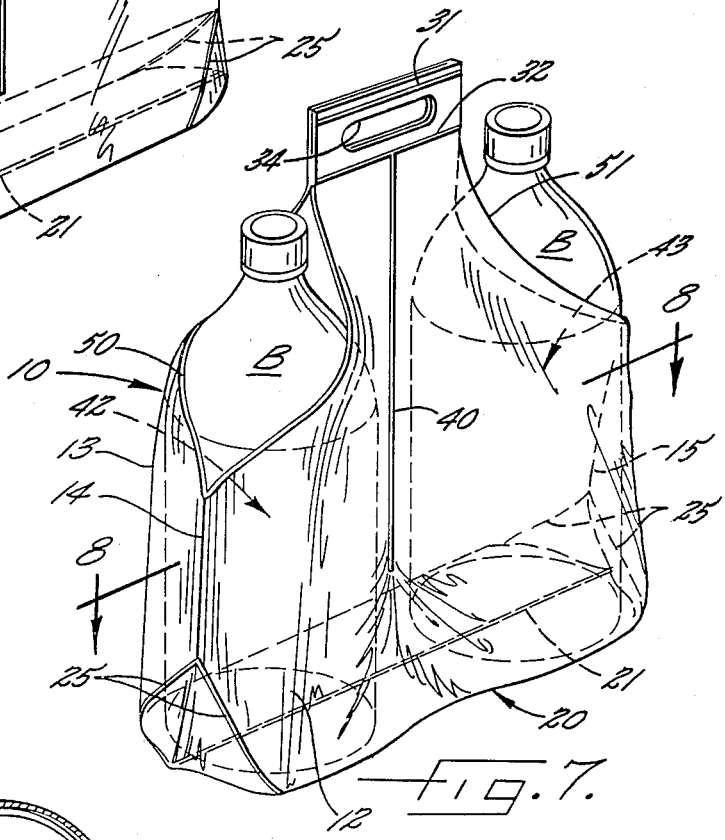
FIG. 7 is a perspective view of the bag of FIGS. 1 and 5 and shown in the open condition thereof and containing a large beverage bottle in each of the side-by-side compartments.
Figure 8:
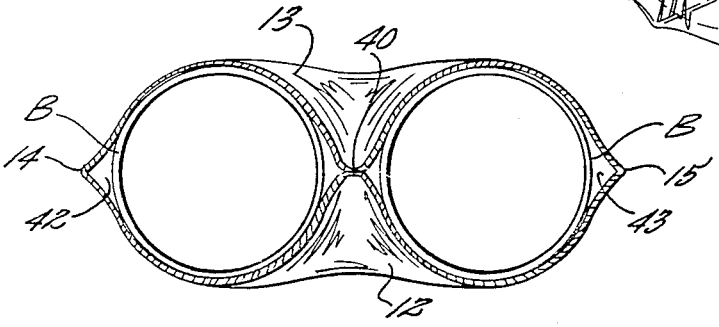
FIG. 8 is a sectional view taken generally along the line 8—8 of FIG. 7.

Referring now to the drawings, a two-compartment plastic bag, generally indicated by the reference numeral 10, is illustrated therein and is particularly adapted for carrying two beverage bottles B or like products (FIG. 7). The bag 10 is fabricated from tubular flexible thermoplastic film which may be extrusion-blown from any suitable resins or otherwise produced in a manner well known by those with ordinary skill in the art of making plastic bags for carrying comodities or other products.

Figure 1:
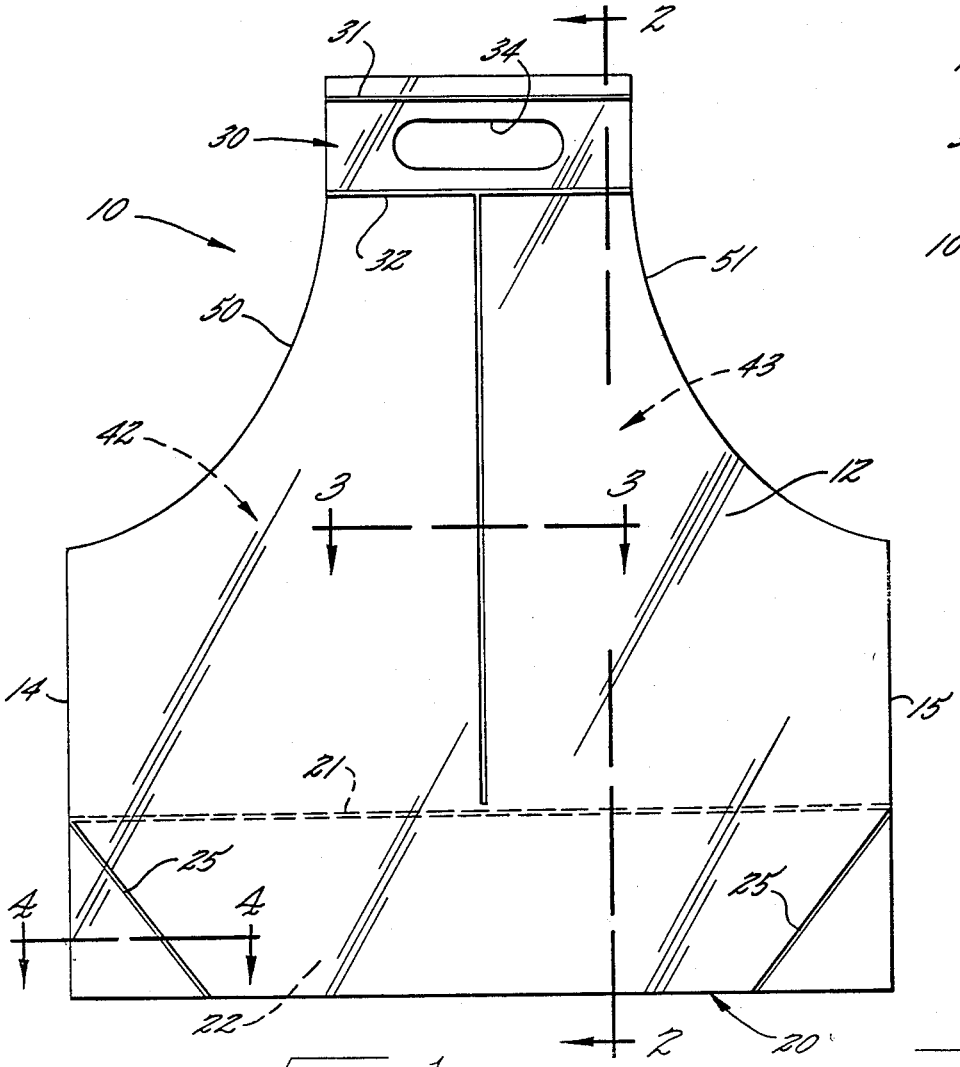
FIG. 1 is a front elevational view of the two-compartment bag of this invention in the flat condition thereof.

In its flat condition (FIG. 1), the bag 10 includes generally coextensive overlying front and rear wall portions 12, 13 integrally joined at longitudinally-extending side edges 14, 15. The bag 10 of this invention has no need for side gusseted portions which are prevalent in most plastic grocery and commodity bags now being produced.

Figure 2:
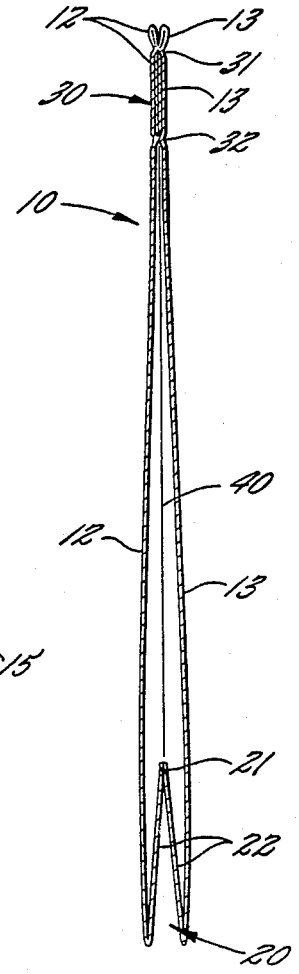
FIG. 2 is a sectional view through the bag of FIG. 1 and taken generally along the line 2—2 of FIG. 1.
Figure 3:
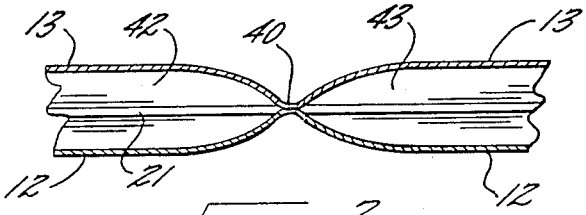
FIG. 3 is a partial sectional view through the bag of FIG. 1 and taken generally along the line 3—3 of FIG. 1.

The bag 10 further includes a bottom portion, generally indicated at 20, including a heat seal 21 extending transversely across and securing together bottom edges of the front and rear wall portions 12 and 13 to close the bottom portion 20 in the bag 10. Preferably, a gusseted bottom wall 22 (FIGS. 1 and 2) is provided and is formed by enfolding a predetermined length of the front and rear wall portions extending from the heat seal 21 in the bottom portion to allow the bottom portion to be opened up (FIGS. 5–7) to sufficient dimensions for receiving beverage bottles B or like products.

Figure 4:
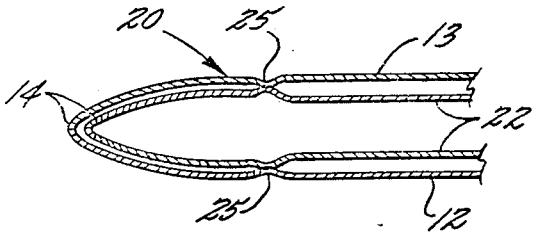
FIG. 4 is a partial sectional view through the bag of FIG. 1 and taken generally along the line 4—4 of FIG. 1.

In accordance with the preferred form of this invention, four generally-diagonal heat seals 25 connect respective front and rear wall portions 12, 13 to a respective part of the gusseted bottom wall 22 adjacent thereto (FIG. 4). Each diagonal heat seal 25 extends at an approximate 45° angle with respect to and from the respective opposite side edges 14, 15 of the front and rear wall portions 12, 13 to the bottom of the bottom portion 20 of bag 10 (FIG. 1) so that the bottom portion 20 of the bag 10 will readily conform to the shape of the bottom of the beverage bottle B or like products when opened up (FIG. 7).

The bag 10 is provided with a top handle portion, generally indicated at 30, which preferably includes spaced-apart heat seals 31, 32 extending transversely across and securing the front and rear wall portions 12, 13 together at a top area thereof which defines the handle portion 30. Preferably, the top handle portion 30 includes at least four layers of thermoplastic film for providing reinforcement and strength to the handle portion. This construction may be provided by folding layers of the front and rear wall portions 12, 13 inwardly into superimposed relationship between outer layers of front and rear wall portions 12, 13 (FIG. 2) prior to forming of the heat seals 31, 32 which will heat seal these layers together. The top handle portion 30 further includes a hand-receiving cutout 34 formed through the layers of the front and rear wall portions 12, 13 forming the top handle portion 30 and between the spaced-apart heat seals 31, 32, generally medially of the side edges 14, 15 to form a medial grippable handle portion 30 in the bag 10.

A heat seal 40 extends generally longitudinally of and connects the front and rear walls 12, 13 together from the top handle portion 30 toward the bottom portion 20 and is positioned generally medially between the side edges 14, 15 of the front and rear wall portions 12, 13 to define side-by-side compartments 42, 43 within the bag 10 for receipt of two beverage bottles B or like products (FIG. 7).

Figure 5:
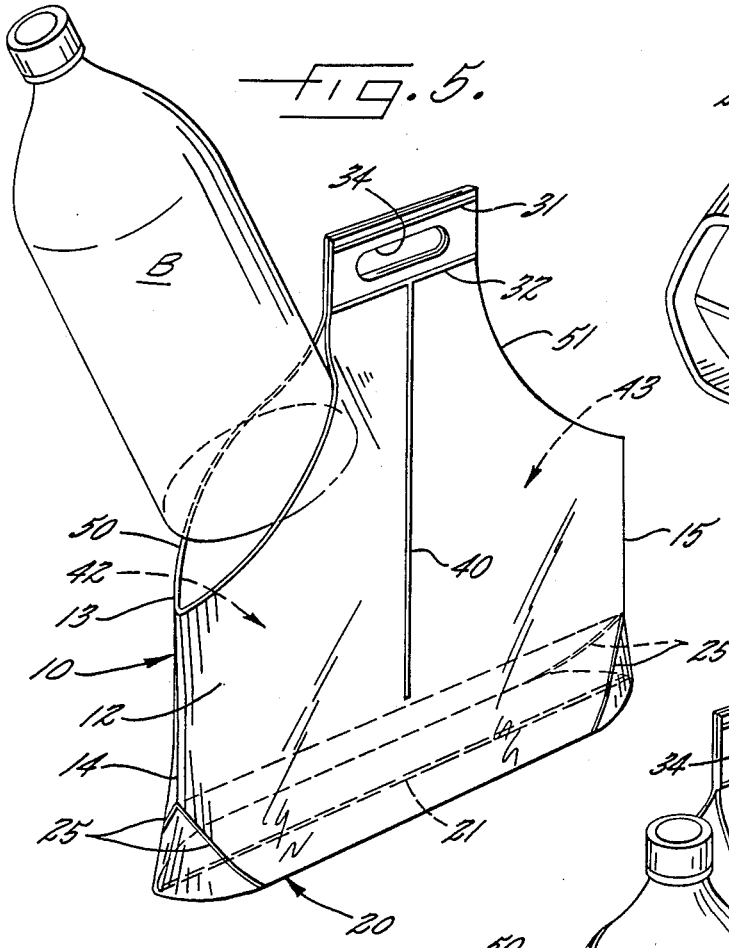
FIG. 5 is a perspective view of the bag of FIG. 1 showing the bag in partially opened condition and receiving a large beverage bottle in one of the side-by-side compartment thereof.
Figure 6:
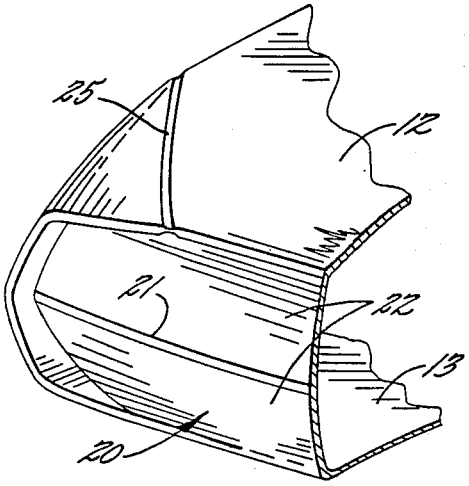
FIG. 6 is a partial perspective view of one side of the bottom of the bag of FIG. 5 and shown in the open condition thereof.

The bag 10 is provided with an open mouth portion 50, 51 at the top of each of the compartments 42, 43 on each side of the top handle portion 30. These open mouth portions 50, 51 are formed by respective oppositely curved cutouts of the front and rear wall portions 12, 13. Each cutout extends downwardly from the top of the top handle portion 30 and outwardly to the respective side edges 14, 15 of the front and rear wall portions 12, 13 to form an easy insert mouth portion 50, 51 for each of the compartments 42, 43 of the bag 10 on each side of the medial handle portion 30. With this arrangement, the mouth portions 50, 51 can be easily opened on each side of the bag for insertion and removal of large beverage bottles B or like products (FIGS. 5 and 7).

Thus, a construction of a two-compartment plastic bag 10 has been provided which provides for easy insertion and removal of two large beverage bottles B or the like products into and out of the side-by-side compartments 42, 43 of the bag, easy conformability of the bottom portion 20 of the bag when opened up to the shape of the products contained therein, and a reinforced handle portion 30 for carrying the bag 10.

In the drawings and specification there has been set forth a preferred embodiment of this invention, and although specific terms are employed, they are used in a generic and descriptive sense only and not for purposes of limitation, the scope of the invention is defined in the following claims.

What is claimed is:

1. A two-compartment plastic bag particularly adapted for carrying two large beverage bottles or like products and being characterized by a construction providing easy insertion and removal of such products into and out of said bag; said bag being fabricated from tubular flexible thermoplastic film and comprising in the flat condition thereof:

generally coextensive overlying front and rear wall portions integrally joined at longitudinally-extending side edges thereof;

a bottom portion including a heat seal extending transversely across and securing together bottom edges of said front and rear wall portions for closing said bottom portion;

a top handle portion including spaced-apart heat seals extending transversely across and securing said front and rear wall portions at a top area thereof, and a hand-receiving cutout formed through said front and rear wall portions between said spaced-apart heat seals and positioned generally medially of the side edges of said front and rear wall portions to form a medial grippable handle in said bag;

a heat seal extending generally longitudinally of and connecting said front and rear wall portions from said top handle portion toward said bottom portion and positioned generally medially between the side edges of said front and rear wall portions to define side-by-side compartments within said bag; and an open mouth portion at the top of each of said compartments on each side of said top handle portion and being formed by respective oppositely curved cutouts of said front and rear wall portions and each extending downwardly from the top of said top handle portion and outwardly to the said respective side edges of said front and rear wall portions to form easy insert mouths for each said compartment of said bag.

2. A two-compartment plastic bag, as set forth in claim 1, in which said top handle portion further includes at least four layers of said thermoplastic film for providing reinforcement and strength to said grippable handle.

3. A two-compartment plastic bag, as set forth in claim 1, in which said bottom portion further includes a gusseted bottom wall, formed by enfolding of a predetermined length of said front and rear wall portions extending from said heat seal in said bottom portion, to allow said bottom portion to be opened up to sufficient dimensions for receiving beverage bottles or like products.

4. A two-compartment plastic bag, as set forth in claim 3, further including four generally-diagonal heat seals connecting said respective front and rear wall portions to a respective part of said gusseted bottom wall adjacent thereto and each extending at an approximate 45° angle with respect to and from the respective opposite side edge of said front and rear wall portions to the bottom of said bottom portion of said bag, so that said bottom portion at each of said compartments will readily conform to the shape of the bottom of beverage bottles or like products when opened up.

5. A two-compartment plastic bag particularly adapted for carrying two beverage bottles or like products and being characterized by a construction providing easy insertion and removal of such products into and out of said bag and easy conformability of the bottom of said bag to the shape of the products contained therein; said bag being fabricated from tubular flexible thermoplastic film and comprising in the flat condition thereof:

generally coextensive overlying front and rear wall portions integrally joined at longitudinally-extending side edges thereof without side gussets therein;

a bottom portion including a heat seal extending transversely across and securing together bottom edges of said front and rear wall portions for closing said bottom portion, and a gusseted bottom wall formed by enfolding of a predetermined length of said front and rear wall portions extending from said heat seal in said bottom portion to allow said bottom portion to be opened up to sufficient dimensions for receiving beverage bottles or like products;

four generally-diagonal heat seals connecting said respective front and rear wall portions to a respective part of said gusseted bottom wall adjacent thereto and each extending at an approximate 45° angle with respect to and from the respective opposite side edge of said front and rear wall portions to the bottom of said bottom portion of said bag, so that said bottom portion will readily conform to the shape of the bottom of beverage bottles or like products when opened up;

a top handle portion formed in a medial part of said front and rear wall portions of the top of said bag;

a heat seal extending generally longitudinally of and connecting said front and rear wall portions from said top handle portion toward said bottom portion and positioned generally medially between the side edges of said front and rear wall portions to define side-by-side compartments within said bag; and an open mouth portion at the top of each of said compartments on each side of said top handle portion and being formed by respective oppositely curved cutouts of said front and rear wall portions and each extending downwardly from the top of said top handle portion and outwardly to said respective side edges of said front and rear wall portions to form an easy insert mouth for each said compartment of said bag.

6. A two-compartment plastic bag, as set forth in claim 5, in which said top handle portion includes spaced-apart heat seals extending transversely across and securing said front and rear wall portions at a top area thereof, and a hand-receiving cutout formed through said front and rear wall portions between said spaced-apart heat seals and positioned generally medially of the side edges of said front and rear wall portions to form a medial grippable handle in said bag, said top handle portion including at least four layers of said thermoplastic film for providing reinforcement and strength to said grippable handle.

* * * * *